US008704463B2

(12) United States Patent
Lin et al.

(10) Patent No.: US 8,704,463 B2
(45) Date of Patent: Apr. 22, 2014

(54) TEMPERATURE CONTROL METHOD AND APPARATUS FOR LIGHT EMITTING DIODE AND LIQUID CRYSTAL DISPLAY

(75) Inventors: Poshen Lin, Shenzhen (CN); Liangchan Liao, Shenzhen (CN); Xiang Yang, Shenzhen (CN)

(73) Assignee: Shenzhen China Star Optoelectronics Technology Co., Ltd, Guangdong (CN)

( * ) Notice: Subject to any disclaimer, the term of this patent is extended or adjusted under 35 U.S.C. 154(b) by 146 days.

(21) Appl. No.: 13/381,333

(22) PCT Filed: Nov. 17, 2011

(86) PCT No.: PCT/CN2011/082318

§ 371 (c)(1),
(2), (4) Date: Dec. 28, 2011

(87) PCT Pub. No.: WO2013/067717

PCT Pub. Date: May 16, 2013

(65) Prior Publication Data

US 2013/0120677 A1 May 16, 2013

(30) Foreign Application Priority Data

Nov. 10, 2011 (CN) ..... 2011 1 0355193

(51) Int. Cl.
*G05F 1/10* (2006.01)
*G09G 3/30* (2006.01)

(52) U.S. Cl.
USPC ..... 315/309; 315/308; 315/291; 315/297; 315/225; 345/87; 345/102

(58) Field of Classification Search
USPC ..... 315/309, 86, 291, 247, 362, 246, 299, 315/294, 307, 308, 297; 345/101, 102
See application file for complete search history.

(56) References Cited

U.S. PATENT DOCUMENTS

| | | | | |
|---|---|---|---|---|
| 6,963,175 | B2 * | 11/2005 | Archenhold et al. | 315/291 |
| 7,330,002 | B2 * | 2/2008 | Joung | 315/309 |
| 2006/0146002 | A1 * | 7/2006 | Nagata | 345/101 |
| 2006/0220571 | A1 * | 10/2006 | Howell et al. | 315/86 |
| 2007/0057902 | A1 * | 3/2007 | Joung | 345/102 |
| 2007/0200513 | A1 * | 8/2007 | Ha et al. | 315/309 |
| 2007/0290984 | A1 * | 12/2007 | Yang et al. | 345/101 |
| 2009/0274182 | A1 * | 11/2009 | Morikawa et al. | 372/29.015 |
| 2010/0148702 | A1 * | 6/2010 | Shen | 315/309 |
| 2011/0062895 | A1 * | 3/2011 | Ji | 315/309 |

* cited by examiner

*Primary Examiner* — Vibol Tan

(57) ABSTRACT

A temperature control method for light emitting diode (LED) is disclosed, and the method comprises the following steps: acquiring the present temperature of the LED during the light emission of the LED; obtaining a driving electric current corresponding to the present temperature based on the present temperature of the LED; and driving the LED based on the driving electric current. This invention further discloses a temperature control device for the LED and a liquid crystal display.

5 Claims, 3 Drawing Sheets

TEMPERATURE CONTROL METHOD AND APPARATUS FOR LIGHT EMITTING DIODE AND LIQUID CRYSTAL DISPLAY

BACKGROUND OF THE INVENTION

1. Field of the Invention

The present invention relates to liquid crystal display techniques. More particularly, the present invention relates to a temperature control method and apparatus for light emitting diode and liquid crystal display.

2. Description of the Prior Art

With the advancement of liquid crystal display techniques, the demand for the features of the liquid crystal display is getting higher.

A light emitting diode (LED) of the liquid crystal display is exemplified that the LED plays a pivotal role in the liquid crystal display. However, during the light emission, LED suffers a progressive rise in temperature, and in a high temperature, the efficiency of light emission for the LED declines substantially, which further fails to achieve the requirements of the brightness regulations and brings about an abnormal display of images. On the other hand, in a lower temperature, the efficiency of light emission for the LED thrives that eventually the brightness exceeds the requirements of the brightness regulations and the images also suffer an abnormal display.

Accordingly, how to settle the light emission instability of the LED due to excessively high or low temperature and the extended issue of abnormal display of the images, are one of the research direction for the liquid crystal display techniques.

SUMMARY OF THE INVENTION

An objective of the present invention is to provide a temperature control method for light emitting diode (LED), to settle the light emission instability of the LED due to excessively high or low temperature, which further results in the technical issues of abnormal display of images.

To settle the aforementioned issues, the present invention provides a temperature control method for the LED, and the method comprises the following steps:

acquiring the present temperature of the LED by means of a temperature transducer during the light emission of the LED;

searching a driving electric current corresponding to the present temperature from a temperature versus electric current cross-reference table in the memory beforehand; and driving the LED based on the driving electric current.

In the temperature control method for the LED of the present invention, the steps for obtaining a driving electric current corresponding to the present temperature based on the present temperature of the LED further comprises:

comparing the present temperature with a predetermined threshold of temperature, the driving electric current of the LED is let down if the present temperature is higher than the predetermined threshold of temperature, and the driving electric current of the LED is lifted up if the present temperature is lower than the predetermined threshold of temperature.

In the temperature control method for the LED of the present invention, the temperature transducer is a thermosensitive element.

Another objective of the present invention is to provide a temperature control method for the light emitting diode (LED), to settle the light emission instability of the LED due to excessively high or low temperature, and further resulting in technical issues of abnormal display of images.

To settle the aforementioned problems, the present invention provides a temperature control method for the LED, and the method comprises the following steps:

acquiring the present temperature of the LED during the light emission of the LED;

obtaining a driving electric current corresponding to the present temperature of the LED; and driving the LED based on the driving electric current.

In the temperature control method for the LED of the present invention, the steps for obtaining a driving electric current corresponding to the present temperature based on the present temperature of the LED specifically comprises:

obtaining a driving electric current corresponding to the present temperature from a temperature versus electric current relationship in the memory beforehand.

In the temperature control method for the LED of the present invention, the steps for obtaining a driving electric current corresponding to the present temperature based on the present temperature of the LED specifically comprises:

comparing the present temperature with a predetermined threshold of temperature;

the steps of driving the LED based on the driving electric current specifically comprises:

the driving electric current of the LED is let down if the present temperature is higher than a predetermined threshold of temperature, and the driving electric current of the LED is lifted up if the present temperature is lower than the predetermined threshold of temperature.

In the temperature control method for the LED of the present invention, the steps for gaining the present temperature of the LED specifically comprises:

gaining the present temperature of the LED through a temperature transducer.

In the temperature control method for the LED of the present invention, the temperature transducer is a thermosensitive element.

The other objective of the present invention is to provide a temperature control method for the light emitting diode (LED), to settle the light emission instability of the LED due to excessively high or low temperature, and further resulting in technical issues of abnormal display of images.

To settle the aforementioned problems, the present invention provides a temperature control device for the LED, and the device comprises a temperature transducer and a driving module;

the temperature transducer, applied during the light emission of the LED, acquires the present temperature of the LED;

the driving module, applied to obtain a driving electric current according to the present temperature of the LED, and to drive the LED based on the driving electric current.

In the temperature control method for the LED of the present invention, the driving module obtains a driving electric current corresponding to the present temperature from a temperature versus electric current relationship in the memory beforehand, and drives the LED based on the driving electric current.

In the temperature control method for the LED of the present invention, the driving module is further applied to compare the present temperature with a predetermined threshold of temperature:

the driving electric current of the LED is let down if the present temperature is higher than the predetermined threshold of temperature, and the driving electric current of the LED is lifted up if the present temperature is lower than the predetermined threshold of temperature.

In the temperature control method for the LED of the present invention, the device further comprises a timing control driving module;

wherein, the temperature transducer is also applied to transform the present temperature to a digital signal, and further to transmit the digital signal to the timing control chip;

The timing control chip, used to perform digital to analog transformation and to send the analog signal to the driving module.

A further objective of the present invention is to provide a liquid crystal display, to settle the light emission instability of the LED due to excessively high or low temperature, and further resulting in technical issues of abnormal display of images.

To settle the aforementioned problems, the present invention provides a liquid crystal display, and the liquid crystal display comprises a temperature control device for the LED where the temperature control device comprises a temperature transducer and a driving module;

the temperature transducer, applied during the light emission of the LED, acquires the present temperature of the LED;

the driving module, applied to obtain a driving electric current according to the present temperature of the LED, and to drive the LED based on the driving electric current Relative to the prior techniques, the present invention settles the light emission instability of the LED due to excessively high or low temperature, and further boosts the quality of display of images.

This invention is detailed described with reference to the following preferred embodiments and the accompanying drawings.

DETAILED DESCRIPTION OF THE INVENTION

The following embodiments are described with reference to the following accompanying drawings that exemplify the realization of this invention.

Figure 1:
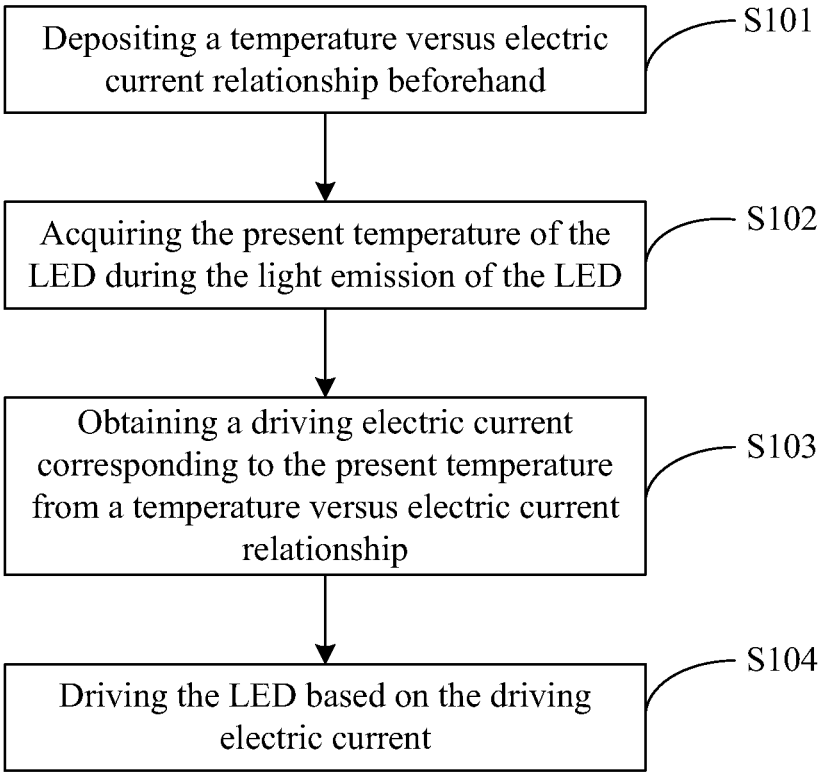
FIG. 1 is a flow chart of a temperature control method of the LED of the first embodiment of the present invention.

Referring to FIG. 1, FIG. 1 is a flow chart of a temperature control method of the LED of the first embodiment of the present invention.

In step S101, depositing a temperature versus electric current relationship in the memory beforehand;

As an exemplary instance, referring to the following relationship, each temperature value corresponds to a driving electric current.

| | Temperature ° C. | | | | |
|---|---|---|---|---|---|
| | −20 | 0 | 20 | 40 | 60 |
| Driving Electric Current mA | 100 | 60 | 40 | 30 | 20 |

In step S102, acquiring the present temperature of the LED during the light emission of the LED;

In a specific realization, the embodiment obtains the present temperature of the LED through a temperature transducer, which means a periodic obtaining of the present temperature is available, that is, for instance, obtaining one every 30 seconds, which will not be iterated herein.

During a specific realization of the techniques of the present invention, the temperature transducer can be a thermosensitive element, and the resistance values of the thermosensitive element correspond to the present temperature values respectively. For example, the present temperature is 20° C., which corresponds to a resistance value 10Ω for the thermosensitive element, and the present temperature is 50° C., which corresponds to a resistance value 30Ω for the thermosensitive element.

In step S103, obtaining a driving electric current corresponding to the present temperature shown in FIG. 1 from a temperature versus electric current relationship;

In step S104, driving the LED based on the driving electric current;

In a specific realization, the temperature of the LED is obtained through a temperature transducer, and the temperature is transformed to a digital signal that is further converted to an analog signal by a timing control chip of the circuits, followed by transmitting the digital signal to a driving module, and once the corresponding driving current is obtained, the driving module proceeds to drive.

Obviously, the preferred embodiment is capable of acquiring the present temperature of the LED, and adjusting dynamically the driving current of the LED according to the present temperature of the LED, which effectively avoids the phenomenon of the temperature in excessively high or low, assuring a stable light emission efficiency of the LED that boosts the quality of the display of images for the liquid crystal display.

Figure 2:
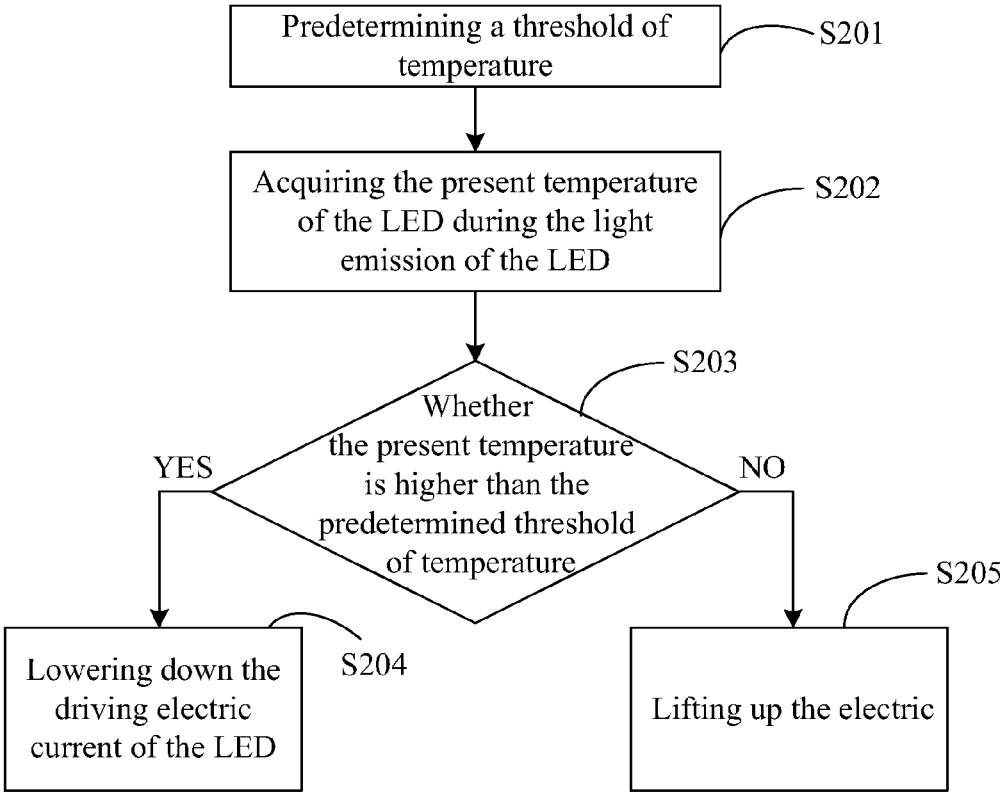
FIG. 2 is a flow chart of the temperature control method of the LED of the second embodiment of the present invention.

FIG. 2 is a flow chart of the temperature control method of the LED of the second embodiment of the present invention.

In step S201, predetermining a threshold of temperature;

In step S202, acquiring the present temperature of the LED during the light emission of the LED;

In step S203, comparing the present temperature with a predetermined threshold of temperature, to see if the present temperature is higher than the predetermined threshold of temperature; then proceeding to execute the step S204 ifYES; otherwise, to the step S205 if NO.

In step S204, lowering down the driving electric current of the LED;

In step S205, lifting up the driving electric current of the LED;

As an exemplary instance, a threshold of temperature is set to 60° C. beforehand, once the acquired present temperature of the LED is 80° C., the driving electric current of the LED is let down; whereas the acquired present temperature of the LED is 15° C., the driving electric current of the LED is lifted up.

Figure 3:
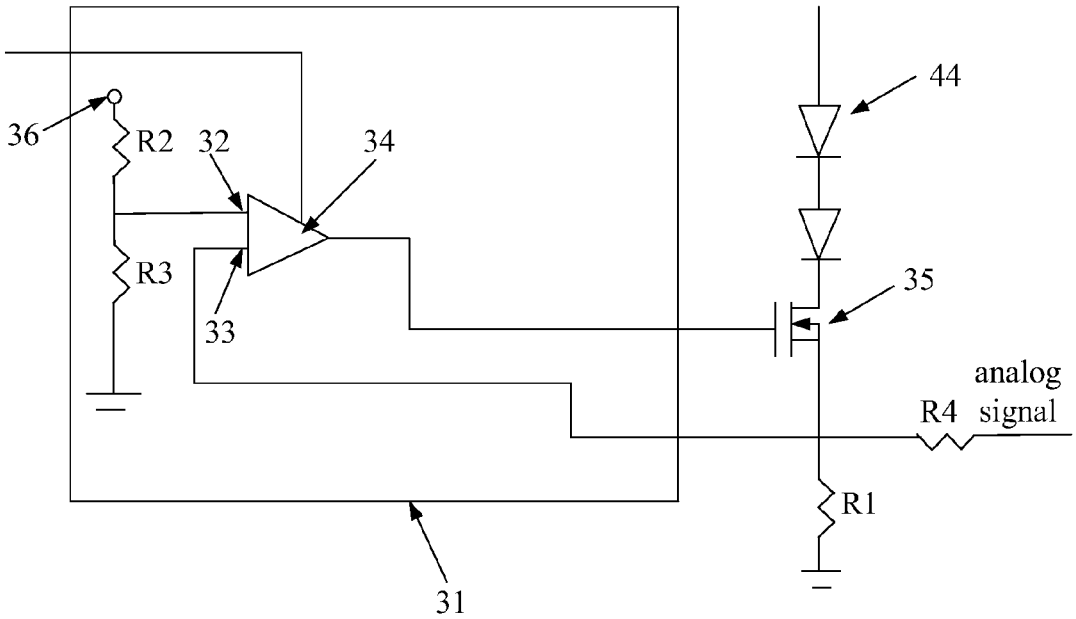
FIG. 3 is a circuit diagram of the internal of the driving module of this invention.

As an exemplary instance, referring to FIG. 3, FIG. 3 is a schematic diagram of the driving module 31 of the LED.

The voltage corresponding to the input current 34 of the driving module 31 is as follows:

$$V_{REF}*r3/(r2+r3)/r1;$$

where r1, r2 and r3 are the resistances for resistors R1, R2 and R3 respectively. $V_{REF}$ is the reference voltage 46.

Where the voltages at pin 32 and pin 33 eventually should be kept the same, which means the voltage across the resistor R1 should be equivalent to $V_{REF}*r3/(r2+r3)$. The embodiment changes the current value by means of the change of the resistance of the MOS 35 to keep the same voltages. If the analog input from the timing control chip (not shown in the figure) passes through the resistor R4 and enforces on the resistor R1, then the voltage equals to $V_{REF}$*r3/(r2+r3) at the current less than the original value, which achieves the goal for the reduction of the electric current.

Obviously, the embodiment is available to acquire the present temperature of the LED, and adjusting dynamically the driving current of the LED according to the present temperature of the LED, which effectively avoids the phenomenon of the temperature in excessively high or low, assuring a stable light emission efficiency of the LED that boosts the quality of the display of images of the liquid crystal display.

Figure 4:
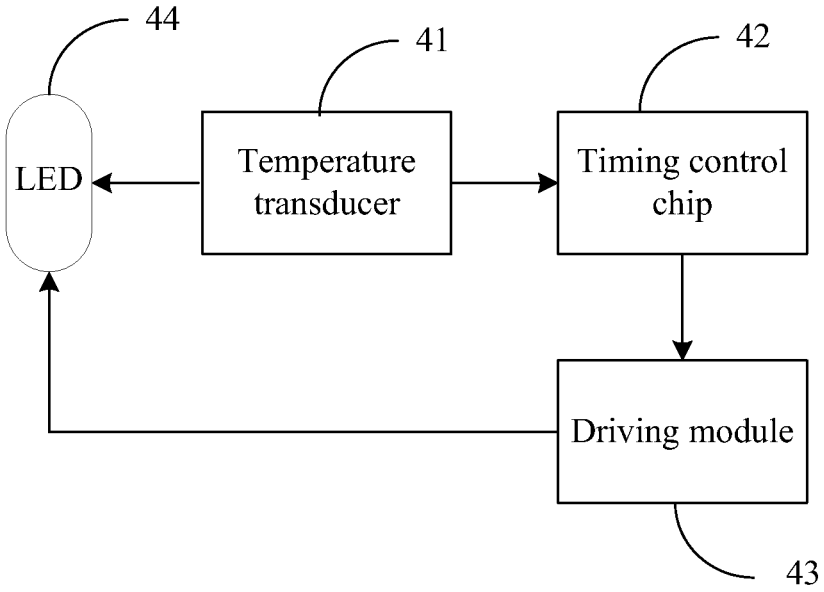
FIG. 4 is a structural diagram of the temperature control device of the LED of a preferred embodiment of this invention.

FIG. 4 is a structural diagram of the temperature control device of the LED of the first preferred embodiment of this invention, the device comprises a temperature transducer 41, a timing control chip 42, a driving module 43 and a LED 44.

Wherein the temperature transducer 41 acquires the present temperature of the LED during the light emission of the LED, the driving module 43 obtains a driving electric current according to the present temperature based on the present temperature of the LED, and drives the LED based on the driving electric current.

As a preferred embodiment of the present invention, the driving module 43 obtains a driving electric current according to the present temperature from a temperature versus electric current relationship in the memory beforehand, and drives the LED based on the driving electric current, where the temperature versus electric current relationship refers to FIG. 2, and no iteration herein.

As a preferred embodiment of the present invention, the driving module 43 compares the present temperature with a predetermined threshold of temperature; the driving electric current of the LED is let down if the present temperature is higher than the predetermined threshold of temperature, and the driving electric current of the LED is lifted up if the present temperature is lower than the predetermined threshold of temperature. Please refer to the foregoing description for the details, and no iteration herein.

In a specific realization, the temperature transducer 21 obtains the present temperature of the LED 44, transforms the temperature to a digital signal, and transmits the digital signal to a timing control chip 42 where the timing control chip 42 converts the digital signal to an analog signal, followed by transmitting the analog signal to a driving module 43.

The driving module 43 is preferably selected to be a driving chip.

The present invention further provides a liquid crystal display, and the liquid crystal display comprises the temperature control device of the LED of the embodiment of the present invention. Since the device is already described in details in the foregoing description, no iteration herein.

In conclusion, the preferred embodiments of this invention are disclosed above; however, the preferred embodiments are used not for the constraint of the this invention; any equivalent modifications made by those of ordinary skill in the art that various changes in form and details may be made therein without departing from the spirit and scope of the present invention. The present invention is intended to be limited only by the scope of the appended claims.

What is claimed is:

1. A temperature control method for light emitting diode (LED), characterized in that: the method comprises the following steps:

acquiring the present temperature of the LED during the light emission of the LED;

obtaining a driving electric current corresponding to the present temperature based on the present temperature of the LED, wherein the present temperature is compared with a predetermined threshold of temperature, the driving electric current of the LED is let down if the present temperature is higher than the predetermined threshold of temperature, and the driving electric current of the LED is lifted up if the present temperature is lower than the predetermined threshold of temperature; and driving the LED based on the driving electric current, wherein the present temperature is transformed to a digital signal and the digital signal is further transmitted to a timing control chip, the timing control chip performs digital to analog transformation and sends the analog signal for obtaining the driving electric current.

2. The temperature control method for the LED as claimed in claim 1, characterized in that: the steps for acquiring the present temperature of the LED specifically comprises:

acquiring the present temperature of the LED through a temperature transducer.

3. The temperature control method for the LED as claimed in claim 2, characterized in that: the temperature transducer is a thermosensitive element.

4. A temperature control device for light emitting diode (LED), characterized in that: the device comprises a temperature transducer, a driving module, and a timing control chip;

the temperature transducer, applied to acquire the present temperature of the LED during the light emission of the LED;

the driving module, applied to obtain a driving electric current according to the present temperature based on the present temperature of the LED, and to drive the LED based on the driving electric current, wherein the driving module is further applied to compare the present temperature with a predetermined threshold of temperature, the driving electric current of the LED is let down if the present temperature is higher than the predetermined threshold of temperature, and the driving electric current of the LED is lifted up if the present temperature is lower than the predetermined threshold of temperature; and the timing control chip, applied to analog transformation and to send the analog signal to the driving module while the temperature transducer transforms the present temperature to a digital signal, and further transmits the digital signal to the timing control chip.

5. A liquid crystal display, characterized in that: the liquid crystal display comprises a temperature control device for the LED where the temperature control device comprises a temperature transducer, a driving module, and a timing control chip;

the temperature transducer, applied to acquire the present temperature of the LED during the light emission of the LED;

the driving module, applied to obtain a driving electric current according to the present temperature based on the present temperature of the LED, and to drive the LED based on the driving electric current, wherein the driving module is further applied to compare the present temperature with a predetermined threshold of temperature, the driving electric current of the LED is let down if the present temperature is higher than the predetermined threshold of temperature, and the driving electric current of the LED is lifted up if the present temperature is lower than the predetermined threshold of temperature; and the timing control chip, applied to analog transformation and to send the analog signal to the driving module while the temperature transducer transforms the present temperature to a digital signal, and further transmits the digital signal to the timing control chip.

* * * * *